US008265537B2

(12) United States Patent
Okuno

(10) Patent No.: US 8,265,537 B2
(45) Date of Patent: Sep. 11, 2012

(54) FIXING DEVICE SLIDE MEMBER AND FIXING DEVICE

(75) Inventor: Jinju Okuno, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 220 days.

(21) Appl. No.: 12/032,256

(22) Filed: Feb. 15, 2008

(65) Prior Publication Data

US 2009/0052956 A1 Feb. 26, 2009

(30) Foreign Application Priority Data

Aug. 21, 2007 (JP) ..... 2007-214433

(51) Int. Cl.
*G03G 15/20* (2006.01)

(52) U.S. Cl. ..... 399/329; 399/122; 399/328; 399/331; 219/216

(58) Field of Classification Search ..... 399/328, 399/329, 331, 122; 219/216
See application file for complete search history.

(56) References Cited

U.S. PATENT DOCUMENTS 4,889,576 A * 12/1989 Suganuma et al. ..... 156/249
5,230,937 A * 7/1993 Effenberger et al. ..... 428/113
5,672,013 A * 9/1997 Ohira ..... 384/297
5,900,453 A * 5/1999 Egami et al. ..... 524/514
7,105,601 B2 * 9/2006 Guo et al. ..... 525/132
7,473,508 B2 * 1/2009 Higuchi et al. ..... 430/110.3
7,493,074 B2 * 2/2009 Komuro ..... 399/328
2004/0131401 A1 * 7/2004 Nakatogawa et al. ..... 399/328
2008/0095557 A1 * 4/2008 Horie ..... 399/329
2008/0219726 A1 * 9/2008 Fukai ..... 399/329

FOREIGN PATENT DOCUMENTS

JP 2004-206105 7/2004
JP 2006-133653 5/2006

OTHER PUBLICATIONS

Japanese Office Action mailed on Aug. 4, 2009 directed at counterpart application No. 2007-214433; 8 pages.
Japanese Office Action mailed on Feb. 23, 2010, directed towards corresponding Japanese Patent Application No. 2007-214433; 4 pages.

* cited by examiner

*Primary Examiner* — David Gray
*Assistant Examiner* — Francis Gray
(74) *Attorney, Agent, or Firm* — Morrison & Foerster LLP

(57) ABSTRACT

A fixing device slide member has a surface 40*a* of a sheet body 40, which surface is made of heat-resistant resin. A specific wear rate on the surface 40*a* of the sheet body 40 in the ring-on-disc test is $10\times10^{-8}$ $mm^3/(N\times m)$ or less on condition that a counterpart material is aluminum, roughness Ra is equal to 0.2 micrometer, PV is equal to 51.2 MPa×m/min, and measuring time is 50 hours. Thus, the surface 40*a* of the sheet body 40 is enhanced in wear resistance so as to be free from generation of worn powder, which suppresses torque increase in a pressurizing belt caused by the worn powder.

17 Claims, 4 Drawing Sheets

FIXING DEVICE SLIDE MEMBER AND FIXING DEVICE

CROSS-REFERENCE TO RELATED APPLICATION

This application is based on application No. 2007-214433 filed in Japan, the entire content of which is hereby incorporated by reference.

BACKGROUND OF THE INVENTION

The present invention relates to a slide member for fixing devices for use in, for example, image forming apparatuses such as copying machines, laser printers and facsimiles, and relates to a fixing device using the slide member.

Conventionally, there has been a fixing device composed of a heating roller, a pressurizing belt which is in contact with the heating roller, and a pressing member which is placed inside the pressurizing belt to press an inner surface of the pressurizing belt toward the heating roller (see JP 2004-206105 A).

Further, in order to reduce sliding resistance of the pressurizing belt, a slide member is inserted between the pressing member and the pressurizing belt, while a lubricant is interposed between the inner surface of the pressurizing belt and a sliding surface of the slide member.

One of the functions that the slide member is required to fulfill is wear resistance of the sliding surface of the slide member. However, in the slide member of the conventional fixing device, the wear resistance is not fully taken into consideration.

Accordingly, when the sliding surface of the slide member is abraded away, the sliding surface is roughened. Therefore, a friction coefficient of the sliding surface is increased. Also, virtual viscosity of the lubricant is increased when worn powder of the sliding surface is mixed into the lubricant. Those do increase torque of the pressurizing belt.

When the torque of the pressurizing belt increases, molten toner on the image surface side becomes slippery to generate image slip. Also, driving abnormality is generated due to driving failure of the pressurizing belt.

BRIEF SUMMARY OF THE INVENTION

An object of the present invention is to provide a fixing device slide member which has enhanced wear resistance, which is free from generation of worn powder, and which suppresses increase in torque of a pressurizing belt caused by the worn powder, and to provide a fixing device having the slide member.

In order to achieve the above-mentioned object, one aspect of the present invention provides a fixing device slide member comprising a sheet body, one surface of which is made of a material containing heat-resistant resin, wherein a specific wear rate of the one surface of the sheet body in a ring-on-disc test is $10\times10^{-8}$ $mm^3/(N\times m)$ or less on condition that a counterpart material is aluminum, roughness Ra is equal to 0.2 micrometer, PV is equal to 51.2 MPa×m/min, and measuring time is 50 hours.

According to the fixing device slide, the wear resistance of the one surface of the sheet body is enhanced because the one surface of the sheet body made of material containing heat-resistant resin, and a specific wear rate on the one surface of the sheet body is $10\times10^{-8}$ $mm^3/(N\times m)$ or less.

When the slide member is used for a fixing device, the one surface of the sheet body is used as a sliding surface which slides on a rotation unit of the fixing device. Thereby, the wear of the one surface of the sheet body is suppressed, so that there is no generation of worn powder from the sheet body. As the result, there is no torque increase of the rotation unit due to the worn powder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinbelow, the present invention is described in detail in conjunction with embodiments with reference to the drawings.

First Embodiment

Figure 1:
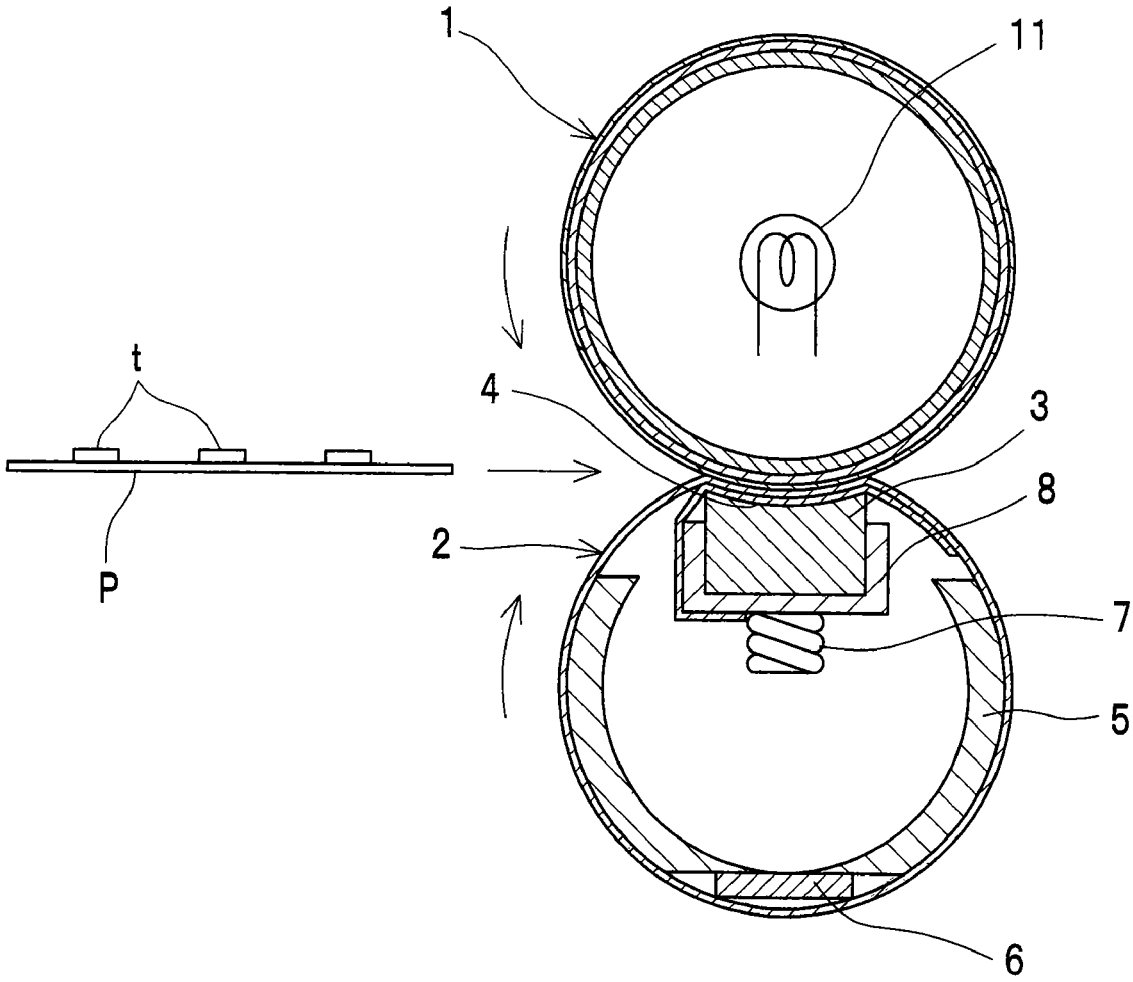
FIG. 1 is a simplified schematic view of a fixing device according to a first embodiment of the present invention.

As shown in FIG. 1, a fixing device according to a first embodiment of the present invention has a heating roller 1 and a pressurizing belt 2 (as a pair of rotation units), which rotate together with their peripheral faces coming into contact with each other.

A pressing member 3 is placed inside the pressurizing belt 2 (as one rotation unit). The pressing member 3 presses an inner surface of the pressurizing belt 2 toward the heating roller 1 (as the other rotation unit).

A slide member 4 is placed between the pressurizing belt 2 and the pressing member 3. The slide member 4 is made to slide on the inner surface of the rotating pressurizing belt 2.

A lubricant feed section 6 is placed inside the pressurizing belt 2. The lubricant feed section 6 feeds a lubricant to the inner surface of the pressurizing belt 2.

The heating roller 1 is rotated by a driving section such as an unshown motor. The pressurizing belt 2 rotates following after the rotation of the heating roller 1 due to the friction between the heating roller 1 and the pressurizing belt 2. The heating roller 1 is heated by a heating heater 11 placed inside the heating roller 1. Heat is transmitted from the heating roller 1 to the pressurizing belt 2.

The heating roller 1 and the pressurizing belt 2 have contact with each other and transport a recording material P so as to fix toner t on the recording material P at the same time. In other words, the recording material P is transported by a nip section, which is formed by the contact between the heating roller 1 and the pressurizing belt 2, while simultaneously melting and fixing the toner t on the recording material P. Pressing by elastic deformation of the pressing member 3 makes it possible to successfully fix the toner t onto the recording material P.

The recording material P is exemplified by such a sheet as a paper sheet and an OHP sheet. The toner t, which is attached to one surface of the recording material P, is made of materials having thermal meltability, such as resins, magnetic substances and colorants.

The heating roller 1 comes into contact with one surface (image surface) of the recording material P. The heating roller 1 is hollow. The heating roller 1 has a core layer, an elastic layer and an outer layer in order from inside to outside. The outside diameter of the heating roller 1 is 26 mm, for example. The core layer is made of aluminum material having 2 mm in thickness, for example. The elastic layer is made out of silicone rubber having 200 micrometer in thickness, for example. The outer layer is made out of PFA tube having 20 micrometer in thickness, for example.

The pressurizing belt 2 is an endless belt. The pressurizing belt 2 has an outside diameter of 30 mm, and is made of polyimide material having 70 micrometer in thickness, for example.

The inside of the pressurizing belt 2 is provided with a supporter (not shown). A pedestal 8 is attached to the supporter via a compression spring 7. The pressing member 3 is fixed to the pedestal 8. The pressing member 3 is a pad made out of silicone rubber, for example.

The slide member 4, which is formed into a sheet, is fixed to the pedestal 8 so as to cover the pressing member 3. Specifically, one end of the slide member 4 is fixed to the pedestal 8 while the other end of the slide member 4 is free, where the one end is located upstream of the pressing member 3 in the rotation direction of the pressurizing belt 2 while the other end is located downstream thereof.

A pair of support members 5 are each attached to both axial ends of the pressurizing belt 2. The pair of these support members 5 supports the pressurizing belt 2 from the inner surface thereof. The support member 5 is formed into a C shape as seen from the axial direction of the pressurizing belt 2.

The lubricant feed section 6 applies the lubricant to the inner surface of the pressurizing belt 2 so as to secure the lubricity between the pressurizing belt 2 and the slide member 4. The lubricant feed section 6 is an oil application felt, for example. The lubricant is silicone oil, for example.

Figure 2:
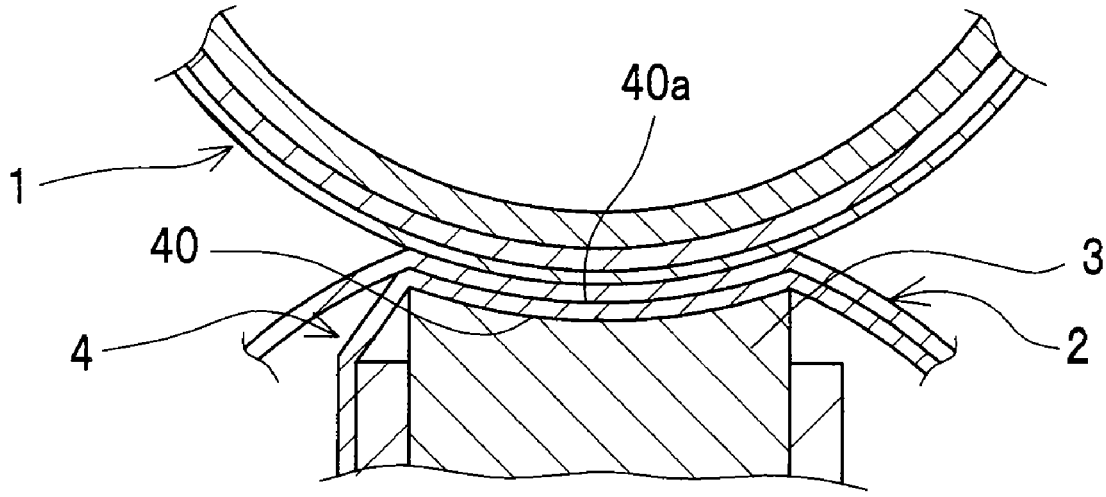
FIG. 2 is an enlarged partial view of the fixing device shown in FIG. 1.

As shown in FIG. 2 which is an enlarged partial view of the fixing device, the slide member 4 is formed out of a sheet body 40. One surface 40*a* of the sheet body 40 is made to slide on the inner surface of the rotating pressurizing belt 2.

The surface 40*a* is formed out of a layer (mentioned later) containing heat-resistant resin. A specific wear rate on the surface 40*a* is $10\times10^{-8}$ $mm^3/(N\times m)$ or less in the ring-on-disc test, where the test condition is that a counterpart material is aluminum with roughness being Ra=0.2 micrometer, PV=51.2 MPa×m/min, and measuring time is 50 hours.

The heat-resistant resin is, for example, fluorine based resin and polyimide based resin. Using fluorine based resin, as the heat-resistant resin, makes it possible to enhance slidability of the surface 40*a*. Fluorine based resin is polytetrafluoroethylene (PTFE), for example. Using polyimide based resin, as the heat-resistant resin, makes it possible to further enhance heat resistance of the surface 40*a*.

Second Embodiment

Figure 3:
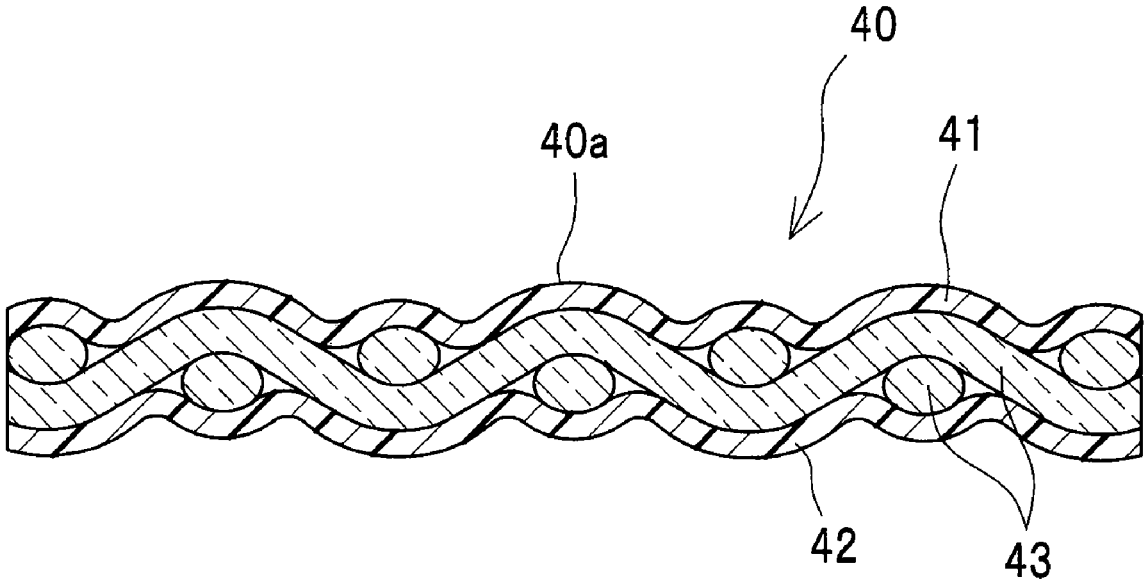
FIG. 3 is a cross sectional view of a fixing device slide member according to a second embodiment of the present invention.

As shown in FIG. 3, which is a cross sectional view of a fixing device slide member according to a second embodiment of the present invention, the sheet body 40 has a first layer 41, a substrate 43 and a second layer 42 which have been placed in order from the surface 40*a* to the other opposite surface.

The first layer 41 and the second layer 42 are made of heat-resistant resin. The substrate 43 is made out of glass cloths.

The first layer 41 and the second layer 42 are formed by molding heat-resistant resin into a cylindrical or columnar shape by the compression molding method, and thereafter by molding it into a sheet shape through skive processing.

The first layer 41 and the second layer 42 are bonded to the substrate 43 with an adhesive.

Thus, the wear resistance of the sheet body 40 can be further enhanced, compared with the case where a glass cloth is impregnated with heat-resistant resin and then is calcined to form a sheet body. Materials having high molecular weight may be selected in order to enhance the wear resistance of the sheet body 40.

The second layer 42 prevents the sheet body 40 from warping. This makes it easy to attach the slide member 4 to the fixing device. On the contrary, if the sheet body 40 is composed of only the first layer 41 and the substrate 43, the sheet body 40 will warp to wind around the belt. This makes it difficult to attach the slide member 4 to the fixing device.

The first layer 41 constitutes a sliding layer which slides on the inner surface of the pressurizing belt 2. The second layer 42 constitutes a warp preventive layer which prevents the sheet body 40 from warping.

The first layer 41 and the second layer 42 are made of materials similar to each other with respect to specific gravity, elongation, compressive elasticity modulus, and thermal expansion coefficient. Preferably, the first layer 41 and the second layer 42 are made of same material having same thickness. This makes it possible to further ensure prevention of the sheet body 40 from warping.

The surface 40*a* of the first layer 41, which surface is located opposite to the substrate 43 as a front surface of the slide member 4, is different in surface roughness from the surface of the second layer 42, which surface is located opposite to the substrate 43 as a rear surface of the slide member 4. Therefore, the back and front surfaces of the slide member 4 can easily be identified by appearance. This makes it possible to prevent the front and back surfaces of the slide member 4 from being incorrectly attached to the fixing device.

The front surface 40*a* of the sheet body 40 has an uneven shape. That is to say, the uneven shape of the substrate 43 is reflected upon the surface 40*a* of the first layer 41 and also the surface of the second layer 42.

The lubricant is held by the uneven shape of the surface 40*a*, so that it becomes possible to secure the lubricity between the pressurizing belt 2 and the slide member 4.

Surface roughness Rt of the surface 40*a* is 1 to 50 micrometers. This uneven shape of the surface 40*a* causes no generation of image noise and sufficiently holds the lubricant on the surface 40*a*.

When the surface roughness Rt of the surface 40*a* is smaller than 1 micrometer, it becomes impossible to successfully hold the lubricant on the surface 40*a*. Also when the surface roughness Rt of the surface 40*a* is larger than 50 micrometers, image noise may be generated by the uneven shape of the surface 40*a*.

The thickness of the substrate 43 is 0.09 to 0.13 mm. This thickness allows the sheet body 40 to be made flexible. Therefore, when the slide member 4 is placed between the pressurizing belt 2 and the pressing member 3, the shape of the pressing member 3 is successfully transferred onto the pressurizing belt 2. Also, the uneven shape of the substrate 43 is definitely reflected upon the surface 40*a*, so that the lubricant is sufficiently held on the surface 40*a*.

On the contrary, when the thickness of the substrate 43 is smaller than 0.09 mm, the unevenness of the substrate 43 becomes small, so that the lubricant cannot be sufficiently held on the surface 40*a*. When the thickness of the substrate 43 is larger than 0.13 mm, the sheet body 40 becomes hard, so that the shape of the pressing member 3 cannot successfully be transferred onto the pressurizing belt 2.

The first layer 41 and the second layer 42 are 25 micrometers or less in thickness, respectively. Thus, the thin first and second layers 41 and 42 allow the uneven shape of the substrate 43 to be definitely reflected upon the surface 40*a*, so that the lubricant can successfully be held on the surface 40*a*. Preferably, the first layer 41 and the second layer 42 are about 25 micrometers in thickness. This prevents wrinkles from being generated on the first layer 41 or the second layer 42 during a laminating process for laminating the first and second layers 41, 42 on the substrate 43.

According to the above-structured slide member 4, the surface 40*a* of the sheet body 40 contains heat-resistant resin. A specific wear rate of the surface 40*a* in the ring-on-disc test is $10\times10^{-8}$ $mm^3/(N\times m)$ or less on condition that a counterpart material is aluminum, roughness Ra is equal to 0.2 micrometer, PV is equal to 51.2 MPa×m/min, and measuring time is 50 hours. Thus, the wear resistance of the surface 40*a* has been enhanced.

When the slide member 4 is used for a fixing device, the surface 40*a* is used as a sliding surface which slides on the pressurizing belt 2. Thereby, the wear of the surface 40*a* is suppressed, so that there is no generation of worn powder from the sheet body 40. As the result, torque increase of the pressurizing belt 2 is not caused by the worn powder.

The above-structured fixing device has the slide member 4, the surface 40*a* of which has wear resistance. This makes it possible to suppress generation of slip images, drive failure of the pressurizing belt 2, and wear of the slide member 4.

Third Embodiment

Figure 4:
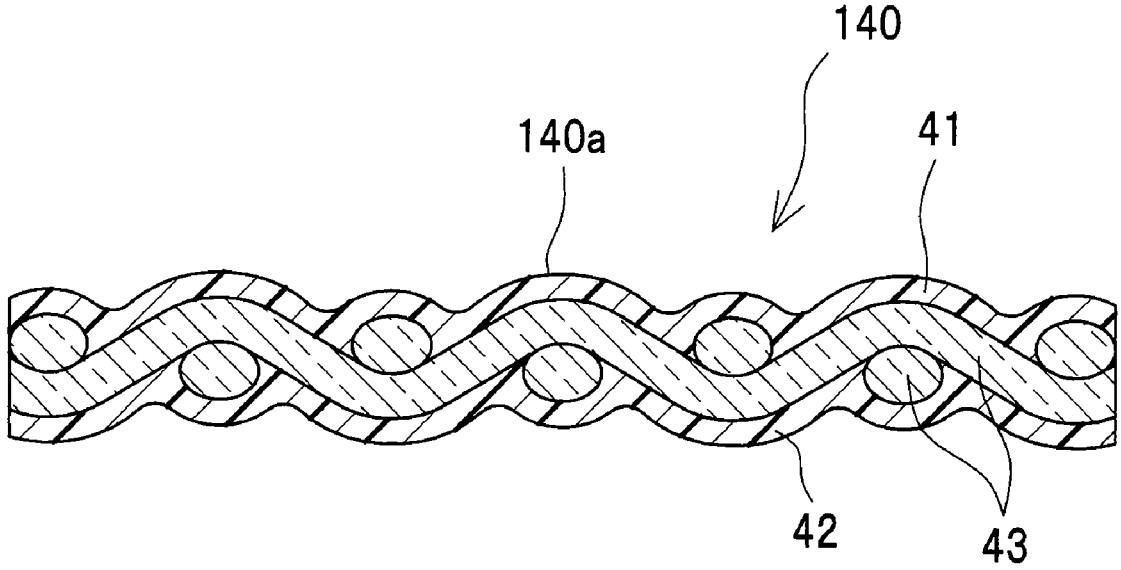
FIG. 4 is a cross sectional view of another fixing device slide member according to a third embodiment of the present invention.

FIG. 4 shows another fixing device slide member according to a third embodiment of the present invention. The third embodiment is different from the second embodiment (FIG. 3) in structure of the sheet body of the slide member. It is to be noted that components in the third embodiment identical to those in the second embodiment are designated by the reference numerals identical to those in the second embodiment (FIG. 3), and description of the identical components is omitted.

A sheet body 140 shown in FIG. 4 is formed by bonding the first layer 41 and the second layer 42 to the substrate 43 with use of heat and pressure instead of an adhesive. As stated in the second embodiment, therefore, the sheet body 140 can be made flexible. Also, the uneven shape of the substrate 43 can definitely be reflected upon a surface 140*a* of the sheet body 140, so that a lubricant can sufficiently be held on the surface 140*a*.

SPECIFIC EXAMPLES

In an endurance test of a fixing device, generation of slip images was examined by using slide members having different specific wear rates. A result thereof is shown in the following Table 1.

In the ring-on-disc test, the specific wear rates of the slide member were set to 8, 10, 20, and 20,000 ($\times10^{-8}$ $mm^3/(N\times m)$) on condition that a counterpart material was aluminum, roughness Ra=0.2 micrometer, PV=51.2 MPa×m/min, and measuring time was 50 hours.

"No generation" is designated by "o" while "generation" is designated by "x" concerning the generation of slip images, drive failure of the pressurizing belt, and abrasion of the slide member.

TABLE 1

| | Specific wear rate $\times10^{-8}$ $mm^3/(N\times m)$ | | | |
|---|---|---|---|---|
| | 8 | 10 | 20 | 20,000 |
| Slip image | o | o | x | x |
| Drive failure of pressurizing belt | o | o | o | x |
| Abrasion of slide member | o | o | o | x |

Table 1 shows that setting the specific wear rate to $10\times10^{-8}$ $mm^3/(N\times m)$ or less makes it possible to provide the fixing device without any generation of slip images, drive failure of the pressurizing belt and abrasion of the slide member.

As a first specific example, a sheet member made of PTFE and having 25 micrometers in thickness was used for the first layer 41 (sliding layer) shown in FIG. 3. The specific wear rate of the sheet member in the ring-on-disc test was $10\times10^{-8}$ $mm^3/(N\times m)$ on condition that a counterpart material was aluminum, roughness Ra was equal to 0.2 micrometer, PV was equal to 51.2 MPa×m/min, and measuring time was 50 hours. A glass cloth was used as the substrate 43. The glass cloth was 0.09 mm in thickness and 0.4 mm to 0.5 mm in mesh pitch. As the second layer 42 (warp preventive layer), a general PTFE sheet having 25-micrometer-thickness was used. The first layer 41, the substrate 43 and the second layer 42 were laminated and bonded by using PFA as an adhesive. Thereafter, a durability test thereof was performed. The result thereof confirmed that there were no generation of slip images, no drive failure of the pressurizing belt and no abrasion of the slide member.

As a second specific example, a sheet member made of PTFE and having 25 micrometers in thickness was used for the first layer 41 (sliding layer) shown in FIG. 4. The specific wear rate of the sheet member in the ring-on-disc test was $10\times10^{-8}$ $mm^3/(N\times m)$ on condition that a counterpart material was aluminum, roughness Ra was equal to 0.2 micrometer, PV was equal to 51.2 MPa×m/min, and measuring time was 50 hours. A glass cloth was used as the substrate 43. The glass cloth was 0.09 mm in thickness and 0.4 mm to 0.5 mm in mesh pitch. As the second layer 42 (warp preventive layer), a general PTFE sheet having 25-micrometer-thickness was used. The first layer 41, the substrate 43 and the second layer 42 were laminated and bonded by application of heat and pressure without use of the adhesive. Thereafter, a durability test thereof was performed. The result thereof confirmed that there were no generation of slip images, no drive failure of the pressurizing belt and no abrasion of the slide member.

In contrast, as a conventional example, a slide member was used which was formed by impregnating a glass cloth having a thickness of 0.1 mm and a mesh pitch of 0.4 to 0.5 mm with PTFE and then by calcinating the resultant glass cloth. Thereafter, the durability test thereof was performed. As the result, abnormalities were observed in all aspects of the slip image, the drive failure in the pressurizing belt and the abrasion of the slide member. This conventional example corresponds to the case where the specific wear rate was $20{,}000\times10^{-8}$ $mm^3/(N\times m)$ in the Table 1.

It should be noted that the present invention shall not be limited to the above-disclosed embodiments and the specific examples. For example, an endless belt may be used instead of the heating roller 1. Also, the sheet body may have a layer other than the first layer, the substrate and the second layer.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A fixing device slide member, comprising a sheet body of the fixing device, having a first layer, a substrate formed out of a glass cloth on the first layer and a second layer on the substrate, wherein one surface of the sheet body is made of a material containing heat-resistant resin, wherein a specific wear rate of the one surface of the sheet body in a ring-on-disc test is $10\times10^{-8}$ $mm^3/(N\times m)$ or less on condition that a counterpart material is aluminum, roughness Ra is equal to 0.2 micrometer, pressure×velocity (PV) is equal to 51.2 MPa×m/min, and measuring time is 50 hours, and wherein there is no generation of worn powder from the sheet body when the fixing device slide member is used in a fixing device.

2. The fixing device slide member set forth in claim 1, wherein the heat-resistant resin is fluorine based resin.

3. The fixing device slide member set forth in claim 1, wherein the heat-resistant resin is polyimide based resin.

4. The fixing device slide member set forth in claim 1, wherein the first layer and the second layer are bonded to the substrate by using an adhesive.

5. The fixing device slide member set forth in claim 1, wherein the first layer and the second layer are bonded to the substrate by using heat and pressure.

6. The fixing device slide member set forth in claim 1, wherein the first layer and the second layer are made of identical materials.

7. The fixing device slide member set forth in claim 1, wherein the first layer and the second layer are made of identical materials and have identical thickness.

8. The fixing device slide member set forth in claim 1, wherein the first layer and the second layer each have a thickness of 25 micrometers or less.

9. The fixing device slide member set forth in claim 1, wherein the substrate has a thickness of 0.09 mm to 0.13 mm.

10. The fixing device slide member set forth in claim 1, wherein the one surface of the sheet body has an uneven shape, and surface roughness Rt of the one surface of the sheet body is 1 micrometer to 50 micrometers.

11. The fixing device slide member set forth in claim 1, wherein one face of the first layer located opposite to the substrate is different in surface roughness from one face of the second layer located opposite to the substrate.

12. A fixing device, comprising:

a pair of rotation units which rotate in a state of being in contact with each other;

a pressing member which is placed inside one rotation unit out of the pair of the rotation units for pressing an inner surface of the one rotation unit toward the other rotation unit out of the pair of the rotation units; and a fixing device slide member of the fixing device, having a sheet body with a first layer, a substrate formed out of a glass cloth on the first layer and a second layer on the substrate, wherein, one surface of the sheet body is made of a material containing heat-resistant resin, wherein a specific wear rate of the one surface of the sheet body in a ring-on-disc test is $10\times10^{-8}$ $mm^3/(N\times M)$ or less on condition that a counterpart material is aluminum, roughness Ra is equal to 0.2 micrometer, pressure×velocity (PV) is equal to 51.2 MPa×m/min, and measuring time is 50 hours, the fixing device slide member being placed between the one rotation unit and the pressing member, wherein the one surface of the sheet body of the fixing device slide member is made to slide on the inner surface of the one rotating rotation unit, and wherein there is no generation of worn powder from the sheet body when the fixing device slide member is used in the fixing device.

13. The fixing device set forth in claim 12, wherein the heat-resistant resin is fluorine based resin.

14. The fixing device set forth in claim 12, wherein the heat-resistant resin is polyimide based resin.

15. The fixing device set forth in claim 12, wherein the first layer and the second layer are made of identical materials.

16. The fixing device set forth in claim 12, wherein the first layer and the second layer are made of identical materials and have identical thickness.

17. The fixing device set forth in claim 12, wherein one face of the first layer located opposite to the substrate is different in surface roughness from one face of the second layer located opposite to the substrate.

* * * * *